US008244146B2

(12) United States Patent
Zaitsu et al.

(10) Patent No.: US 8,244,146 B2
(45) Date of Patent: Aug. 14, 2012

(54) IMAGE FORMING APPARATUS AND IMAGE FORMING METHOD WITH ERROR CORRECTED POTENTIAL MEASUREMENTS

(75) Inventors: Yoshitaka Zaitsu, Kawasaki (JP); Takashi Ushijima, Yokohama (JP); Kaoru Noguchi, Tokyo (JP); Kazuhiko Kato, Tokyo (JP); Toshiyuki Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/166,980

(22) Filed: Jun. 23, 2011

(65) Prior Publication Data

US 2011/0255890 A1 Oct. 20, 2011

Related U.S. Application Data

(62) Division of application No. 11/923,039, filed on Oct. 24, 2007, now abandoned.

(30) Foreign Application Priority Data

Nov. 9, 2006 (JP) ..... 2006-303678

(51) Int. Cl.
*G03G 15/00* (2006.01)

(52) U.S. Cl. ..... 399/48; 399/50; 399/51; 399/73

(58) Field of Classification Search ..... 399/48, 399/50–51, 73
See application file for complete search history.

(56) References Cited

U.S. PATENT DOCUMENTS 4,248,524 A * 2/1981 Takahashi ..... 399/48
4,326,796 A * 4/1982 Champion et al. ..... 324/457
4,433,298 A 2/1984 Palm
4,502,777 A * 3/1985 Okamoto et al. ..... 399/46
4,755,850 A 7/1988 Suzuki et al.
5,043,765 A * 8/1991 Nagashima ..... 399/31
5,153,609 A * 10/1992 Ando et al. ..... 347/129

(Continued)

FOREIGN PATENT DOCUMENTS

JP 55-29859 A 3/1980

(Continued)

OTHER PUBLICATIONS

English machine translation of Japanese document, Masuda (JP 2007-155974A).*

*Primary Examiner* — David Gray
*Assistant Examiner* — Geoffrey Evans
(74) *Attorney, Agent, or Firm* — Fitzpatrick, Cella, Harper & Scinto

(57) ABSTRACT

There is provided an image forming apparatus and method capable of reducing a measurement error in a measurement result of the surface potential of an electrostatic latent image formed on the surface of an image bearing member. The measurement error occurs under the influence of an electric field generated from a pre-exposed area. Consequently, miniaturization of an image forming apparatus and consistent print quality can be achieved. The image forming apparatus includes an image forming control section for determining an error correction value corresponding to the charge state of a latent image on the basis of relationships between charge states of the latent image and error correction values which have been prepared in advance, computing an error corrected potential measurement value using the error correction value and a potential measurement value, and controlling the image forming apparatus on the basis of the error corrected potential measurement value.

13 Claims, 6 Drawing Sheets

U.S. PATENT DOCUMENTS

| | | | | |
|---|---|---|---|---|
| 5,305,060 | A * | 4/1994 | Fukushima | 399/48 |
| 5,357,319 | A * | 10/1994 | Nagashima | 399/48 |
| 5,359,393 | A * | 10/1994 | Folkins | 399/50 |
| 5,404,201 | A * | 4/1995 | Umeda et al. | 399/8 |
| 5,587,778 | A * | 12/1996 | Fukushima et al. | 399/348 |
| 5,659,841 | A * | 8/1997 | Umeda et al. | 399/55 |
| 5,946,018 | A * | 8/1999 | Arai et al. | 347/115 |
| 6,038,038 | A * | 3/2000 | Selby et al. | 358/446 |
| 6,418,280 | B2 * | 7/2002 | Kamiya | 399/46 |
| 6,591,071 | B2 * | 7/2003 | Hayashi | 399/48 |
| 6,647,219 | B2 * | 11/2003 | Buettner | 399/48 |
| 7,457,552 | B2 * | 11/2008 | Mine et al. | 399/48 |
| 7,990,159 | B2 * | 8/2011 | Kato et al. | 324/661 |
| 8,099,005 | B2 * | 1/2012 | Akatsu | 399/48 |
| 8,107,839 | B2 * | 1/2012 | Miyaji et al. | 399/50 |
| 2002/0127026 | A1 | 9/2002 | Kubota et al. | |
| 2005/0220468 | A1 * | 10/2005 | Kitajima | 399/48 |
| 2006/0008284 | A1 * | 1/2006 | Ushijima et al. | 399/48 |
| 2006/0127107 | A1 * | 6/2006 | Kamisuwa et al. | 399/26 |
| 2010/0019779 | A1 * | 1/2010 | Kato et al. | 324/660 |
| 2011/0229820 | A1 * | 9/2011 | Higa | 430/125.3 |
| 2011/0318025 | A1 * | 12/2011 | Thayer et al. | 399/34 |

FOREIGN PATENT DOCUMENTS

| | | | |
|---|---|---|---|
| JP | 61-155863 | A | 7/1986 |
| JP | 62-10425 | B2 | 3/1987 |
| JP | 6-242166 | A | 9/1994 |
| JP | 2007155974 | A * | 6/2007 |

* cited by examiner

IMAGE FORMING APPARATUS AND IMAGE FORMING METHOD WITH ERROR CORRECTED POTENTIAL MEASUREMENTS

This application is a divisional of U.S. patent application Ser. No. 11/923,039, filed Oct. 24, 2007.

BACKGROUND OF THE INVENTION

1. Field of the Invention

The present invention relates to an electrophotographic image forming apparatus such as a copier or a laser beam printer and an electrophotographic image forming method.

2. Description of the Related Art

In order to ensure consistent print quality of image forming apparatuses such as copiers and laser beam printers, the conditions necessary to form an image, for example, a charging voltage and a light quantity of exposure, must be controlled so that the charge density of an electrostatic latent image (also referred to as a latent image) formed on the surface of an image bearing member is maintained at an appropriate value. Accordingly, after the surface of the image bearing member has been charged or exposed to light, the surface potential of the image bearing member is measured by a potential measurement device. The image forming conditions are controlled on the basis of the measurement result. Such a function is generally incorporated into image forming apparatuses. In some of these image forming apparatuses, two types of latent images are formed using a charging device and an exposure device, that is, a low-charge-density latent image obtained by charging the surface of an image bearing member and exposing the charged surface to light and a high-charge-density latent image obtained only by charging the surface of the image bearing member. Subsequently, the surface potentials of the formed latent images are measured. See, Japanese Patent Publication No. 62-10425. In order to obtain desired surface potentials of these latent images, the image forming conditions such as a charge intensity and an exposure intensity are controlled. Thus, consistent print quality is ensured. Herein, the term "charge density" means the amount of electrical charge per unit area.

In image forming apparatuses, it is better to use a potential measurement device capable of measuring the surface potential of an image bearing member in a noncontact manner. See, Japanese Patent Laid-Open No. 6-242166. If a potential measurement device is in contact with the surface of an image bearing member, the charge density of an electrostatic latent image formed on the surface of the image bearing member may be changed. Furthermore, charging characteristics of parts of the surface of the image bearing member may be changed due to the surface wear and the surface modification. As a result, normal potential measurement cannot be performed and consistent image quality cannot be ensured.

When potential measurement is performed, measurement errors occur because of various error factors. In order to perform accurate potential measurement, it is required to remove the causes of these error factors or correct these measurement errors. The error factors include aged deterioration that is the gradual change over time, for example, aged deterioration of charging characteristics of an image bearing member or aged deterioration of drive components of a potential measurement device. In the case of measurement errors caused by such error factors, the method of correcting measurement errors is effective. A potential measurement device employing this method has been disclosed. See, Japanese Patent Laid-Open No. 61-155863. In this potential measurement device, after exposure of the surface of an image bearing member has been performed so as to remove an electrical charge therefrom, the surface potential of the image bearing member is measured. The measurement value is stored in a storage unit as an offset. Subsequently, when the surface potential of a latent image formed on the surface of the image bearing member is measured, the offset is subtracted from the measurement value of the surface potential of the latent image. Thus, a measurement error is corrected.

In order to miniaturize an image forming apparatus, it is required to miniaturize an image bearing member that is a main component of the image forming apparatus. Referring to FIG. 6, with the miniaturization of an image bearing member 1, a charging device 2, an exposure device 3, and a developing device 5 are all disposed near the surface of the image bearing member 1, and are all disposed near a potential measurement device 4. Under such circumstances, it is difficult to accurately measure a surface potential of a latent image formed on the image bearing member 1. The charging device 2 and the developing device 5 each have a high potential source that disturbs an electric field near a measurement surface of the potential measurement device 4, thereby causing measurement errors. In particular, a high-charge-density area 11 between the charging device 2 and the exposure device 3 on the surface of the image bearing member 1 is the high potential source nearest to the potential measurement device 4 and may therefore be a factor responsible for the largest measurement error. Such a high-charge-density area that has not to be exposed to light yet is referred to as a "pre-exposed area 11," hereinafter.

The degree of a measurement error that is caused by the pre-exposed area 11 and affects the surface potential measurement result of a latent image is determined on the basis of the following three factors.

The first factor is the distance between the pre-exposed area 11 and a measurement area 12 on the surface of the image bearing member 1 on which potential measurement is performed. More accurately, the first factor is the distance between an exposure position 13, which is placed at one end of the pre-exposed area 11 and is exposed to light by the exposure device 3, and a measurement area center point 14 directly below the measurement surface of the potential measurement device 4. If this distance is decreased for the miniaturization of the image bearing member, the value of a measurement error is increased. The reason for this is that if the above-described distance is decreased, the influence of an electric field generated from the pre-exposed area 11 on an electric field distribution near the measurement surface under the potential measurement device 4 is increased.

The second factor is a measurement distance 15 of the potential measurement device 4. The measurement distance 15 is the distance between the measurement surface of the potential measurement device 4 and the surface of the image bearing member 1. If the measurement distance 15 increases, the value of the measurement error is increased. The reason for this is that if the measurement distance 15 increases, the sensitivity of the potential measurement device 4 to an electric field generated from an electrostatic latent image formed on the surface of the image bearing member 1 is decreased, whereas the influence of an electric field radially generated from the pre-exposed area 11 is increased. In order to prevent this situation, the measurement distance 15 must be decreased. If the measurement distance 15 is decreased, however, a discharge occurs between the surface of the image bearing member 1 and the potential measurement device 4 during a period other than a potential measurement period. Consequently, there is the increased possibility that the surface of the potential measurement device 4 or the surface of the image bearing member 1 will be destroyed. Accordingly, from the viewpoint of the reliability of an image forming apparatus, the method of decreasing the measurement distance 15 cannot be employed.

The third factor is the difference between the surface potential of the measurement area 12 and the surface potential of the pre-exposed area 11. The larger this potential difference, the higher the value of a measurement error. The reason for this is that if the above-described potential difference is increased, the intensity of an electric field generated from the measurement area 12 becomes lower than that of an electric field generated from the pre-exposed area 11. That is, the influence of the electric field generated from the pre-exposed area 11 becomes relatively strong.

Among the above-described three factors, in the case of the first and second factors, the degree of an influence on a surface potential measurement result is determined in accordance with an element of internal space design of an image forming apparatus, for example, the size of the image bearing member 1, the exposure position 13, or the installation position of the potential measurement device 4. These space design elements are not markedly changed unless there is a change over time or a destructive change in the image forming apparatus. Accordingly, it can be determined that the value of the measurement error caused by the first or second factor is substantially constant over time. In order to reduce such a measurement error, a method can be employed of obtaining the value of a measurement error using an experimental method or a numerical analysis method, storing the obtained value as an offset, and subtracting the offset from a measurement value.

However, in the case of the third factor, the difference between the surface potential of the pre-exposed area 11 and the surface potential of the measurement area 12 is markedly changed in accordance with the charge density of the measurement area 12. Accordingly, the measurement error caused by the third factor is markedly changed in accordance with the charge density of the measurement area 12. In this case, the above-described method of subtracting an offset, which is a constant value, from a measurement value cannot be employed so as to achieve good measurement error reduction.

SUMMARY OF THE INVENTION

The present invention provides an image forming apparatus including: an image bearing member; a charging device configured to charge a surface of the image bearing member; an exposure device configured to expose the surface of the image bearing member to light; a potential measurement device configured to measure a surface potential of an electrostatic latent image that is formed on the surface of the image bearing member by the charging device and the exposure device; a developing device configured to develop the electrostatic latent image; and an image forming control unit configured to control image forming conditions. The image forming control unit determines an error correction value corresponding to a charge state of the electrostatic latent image on the basis of relationships between charge states of the electrostatic latent image and error correction values which have been prepared in advance, computes an error corrected potential measurement value using the determined error correction value and a potential measurement value measured by the potential measurement device, and controls at least one of the charging device, the exposure device, and the developing device on the basis of the computed error corrected potential measurement value.

The present invention provides an image forming method including: charging a surface of an image bearing member; exposing the surface of the image bearing member to light; measuring a surface potential of an electrostatic latent image that is formed on the surface of the image bearing member through the charging and the exposing; developing the electrostatic latent image; determining an error correction value corresponding to a charge state of the electrostatic latent image on the basis of relationships between charge states of the electrostatic latent image and error correction values which have been prepared in advance; computing an error corrected potential measurement value using the error correction value determined in the determining and a potential measurement value measured in the measuring; and controlling at least one of the charging, the exposing, and the developing on the basis of the error corrected potential measurement value computed in the computing.

According to an embodiment of the present invention, it is possible to appropriately correct a measurement error included in a measurement result of the surface potential of an electrostatic latent image formed on the surface of an image bearing member in accordance with the charge state of the electrostatic latent image. The measurement error occurs under the influence of an electric field generated from a pre-exposed area. Accordingly, using an error corrected surface potential measurement value of the electrostatic latent image, image forming conditions can appropriately be controlled.

Further features of the present invention will become apparent from the following description of exemplary embodiments with reference to the attached drawings.

DESCRIPTION OF THE EMBODIMENTS

An image forming apparatus and method according to an embodiment of the present invention will be described below with reference to the accompanying drawings.

First Embodiment

An image forming apparatus and method according to the first embodiment will be described. An image forming apparatus and method according to first embodiment are preferably used in a case a target value (described later) of a pre-exposure potential is not changed or is slightly changed. First, the configuration of an image forming apparatus according to first embodiment will be described with reference to FIG. 2.

Figure 2:
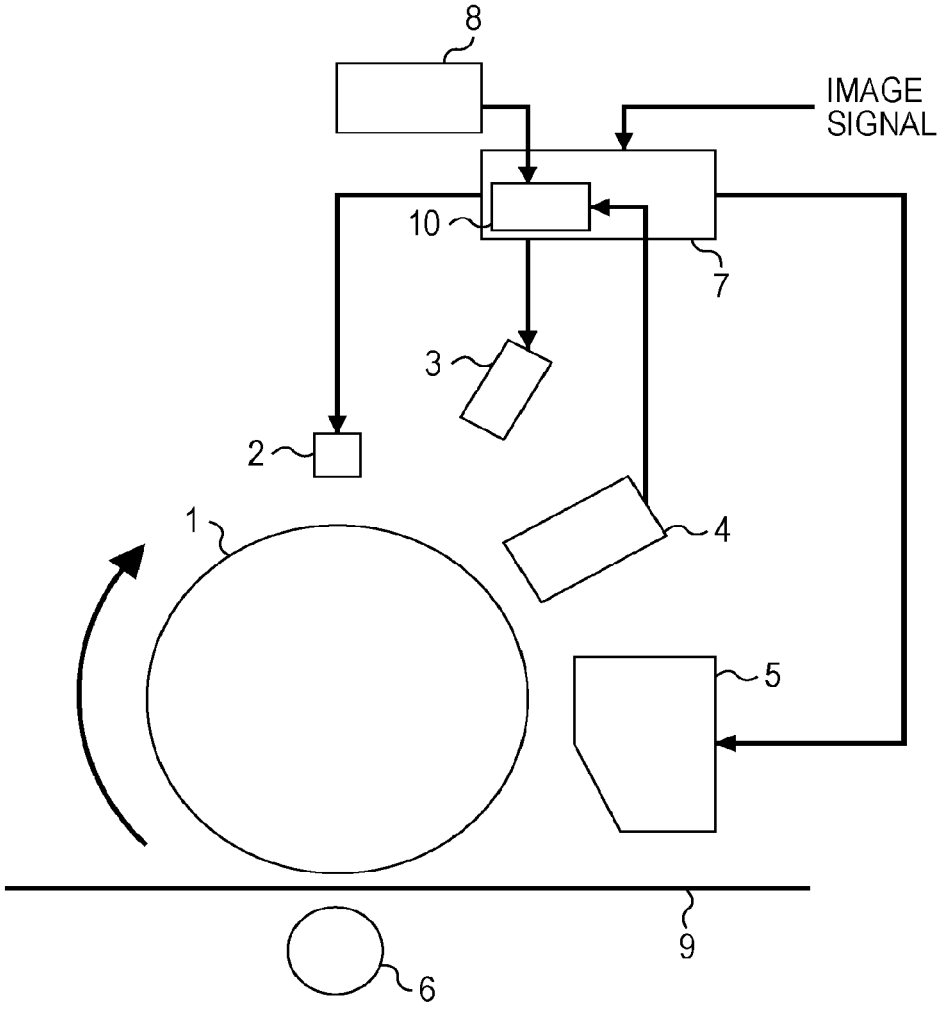
FIG. 2 is a diagram illustrating an image forming apparatus according to an embodiment of the present invention.

As illustrated in FIG. 2, the cylindrical image bearing member 1 rotates about its central axis in a direction indicated by an arc-shaped arrow. The charging device 2, the exposure device 3, the potential measurement device 4, the developing device 5, and a conveying roller 6 are disposed near the surface of the image bearing member 1.

An image forming control section 7 is connected to the charging device 2, the exposure device 3, the potential measurement device 4, and the developing device 5 so that an electrical or optical signal can be exchanged between them. An error correction value output section 8 includes a storage device for storing error correction values corresponding to a plurality of charge densities of the surface of the image bearing member 1. The error correction value output section 8 is connected to the image forming control section 7 so that an electrical or optical signal can be exchanged between them. The potential measurement device 4 may perform potential measurement using a so-called null method (see, Japanese Patent Laid-Open No. 6-242166) or a so-called deflection method (see, Japanese Patent Laid-Open No. 61-155863). In these methods, a detection electrode facing a measurement area on the surface of the image bearing member 1 is used, and potential measurement is performed using an electrical charge that is induced by the detection electrode in accordance with a periodic change in an electrostatic capacity between the measurement area and the detection electrode.

Next, operations performed when the above-described image forming apparatus according to first embodiment forms a print image will be described. First, the charging device 2 charges the surface of the image bearing member 1 by performing, for example, an electrical discharge.

Subsequently, the exposure device 3 selectively exposes the surface of the image bearing member 1 to light, thereby forming a latent image. In the exposed area, the amount of electrical charge is reduced, and the charge density is therefore reduced. As an exposure method, any one of the following methods is used: a method of causing laser beams to scan the surface of the image bearing member 1 in the direction of a rotation axis using, for example, a laser source capable of performing pulse modulation, a galvanometer mirror, a resonant light deflector, and a polygonal mirror; and a method using an LED array. The selection of an area to be exposed to light is performed in such a manner that the image forming control section 7 receives print image information (an image signal) and controls the laser source included in the exposure device 3 on the basis of the received print image information.

Subsequently, the developing device 5 causes an area on the surface of the image bearing member 1 in which electrical charges remain to absorb a developer, thereby developing the latent image. In this description, the area in which electrical charges remain absorbs a developer, however, the area in which the amount of electrical charge has been reduced after exposure may absorb a developer.

Subsequently, the conveying roller 6 conveys a print medium 9 to a position near the surface of the image bearing member 1. The developer existing on the surface of the image bearing member 1 is transferred to the print medium 9. Consequently, a print image corresponding to the above-described image signal is formed on the print medium 9.

Figure 1:
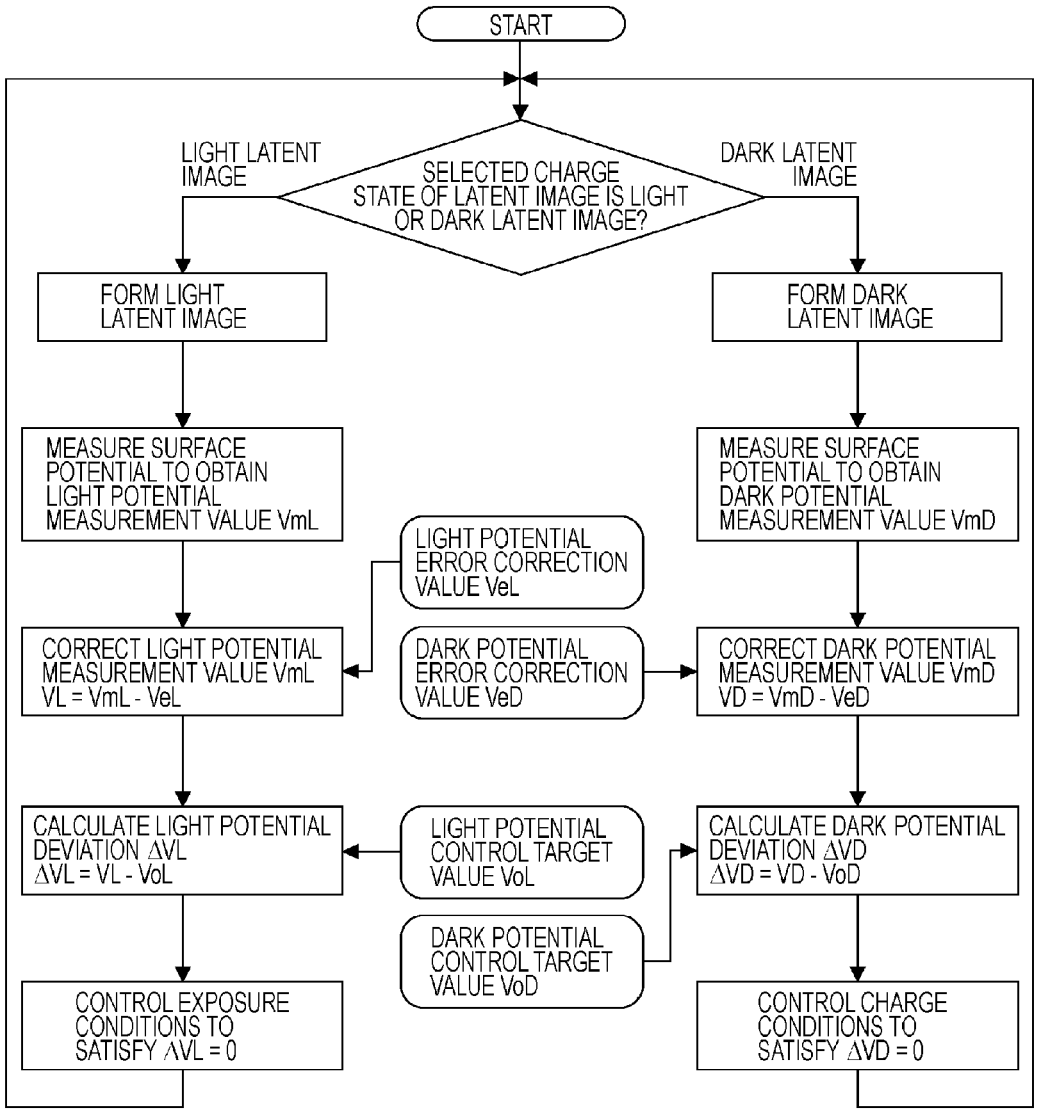
FIG. 1 is a flowchart illustrating a procedure for controlling image forming conditions in an image forming apparatus and method according to a first embodiment of the present invention.

A procedure for controlling image forming conditions at the time of the above-described print image forming performed in an image forming apparatus and method according to the first embodiment will be described with reference to a flowchart illustrated in FIG. 1.

In this description, a latent image formed by exposing a latent image forming area on the surface of an image bearing member is referred to as a "light latent image," and the surface potential of the light latent image is referred to as a "light potential". On the other hand, a latent image formed from the latent image forming area on the surface of the image bearing member without being exposed to light is referred to as a "dark latent image", and the surface potential of the dark latent image is referred to as a "dark potential".

First, the image forming control section 7 selects one of the light latent image and the dark latent image as a charge state to be measured of the surface of the image bearing member 1. As described previously, this selection is performed in accordance with a latent image charge state signal obtained from an image signal received by the image forming control section 7. The image forming control section 7 individually transmits control signals to the charging device 2 and the exposure device 3 on the basis of the selected latent image, thereby forming the selected latent image on the surface of the image bearing member 1. At that time, if the formed latent image is a light latent image, the image forming control section 7 controls the drive conditions for the charging device 2 and the exposure device 3 so as to obtain a light potential control target value VoL. On the other hand, if the formed latent image is a dark latent image, the image forming control section 7 controls the drive conditions for the charging device 2 and the exposure device 3 so as to obtain a dark potential control target value VoD.

Subsequently, the potential measurement device 4 measures the surface potential of the formed latent image. If the measured latent image is a light latent image, a measurement value VmL is obtained. If the measured latent image is a dark latent image, a measurement value VmD is obtained. Information about the measurement value is transmitted from the potential measurement device 4 to the image forming control section 7.

Subsequently, if the measurement value is the light potential measurement value VmL, a measurement error correction unit included in the image forming control section 7 acquires a light potential error correction value VeL from the error correction value output section 8 and subtracts the light potential error correction value VeL from the light potential measurement value VmL. On the other hand, if the measurement value is the dark potential measurement value VmD, the measurement error correction unit acquires a dark potential error correction value VeD from the error correction value output section 8 and subtracts the dark potential error correction value VeD from the dark potential measurement value VmD. Consequently, the measurement error correction unit included in the image forming control section 7 corrects a measurement error, thereby obtaining an error corrected light potential measurement value VL or an error corrected dark potential measurement value VD. The above-described error correction values VeL and VeD are acquired in advance using an experimental method or a numerical analysis method, and are then stored in the error correction value output section 8. In this description, a correction computation processing operation in which the error correction value is subtracted from a measurement value is performed. However, another correction computation processing operation in which a measurement value is multiplied by an error correction coefficient may be performed. This can be applied to other embodiments.

Subsequently, the image forming control section 7 subtracts the light potential control target value VoL from the error corrected light potential measurement value VL, thereby obtaining a light potential deviation ΔVL. Alternatively, the image forming control section 7 subtracts the dark potential control target value VoD from the error corrected dark potential measurement value VD, thereby obtaining a dark potential deviation ΔVD. These control target values are obtained in advance of image forming operations so as to achieve good image forming conditions, and are then stored in a storage device.

In the case of the light potential deviation ΔVL, the image forming control section 7 changes the drive conditions for the exposure device 3 so that the value of the light potential deviation ΔVL becomes zero. For example, if VoL>0, ΔVL>0, the image forming control section 7 increases the light quantity of exposure performed by the exposure device 3. Consequently, the surface potential is decreased, and the value of ΔVL can therefore be closer to zero. Conversely, if VoL>0, ΔVL<0, the image forming control section 7 reduces the light quantity of exposure performed by the exposure device 3. Consequently, the surface potential is increased, and the value of ΔVL can therefore be closer to zero. In the case of the dark potential deviation ΔVD, the image forming control section 7 changes the drive conditions for the charging device 2 so that the value of the dark potential deviation ΔVD becomes zero. For example, if VoD>0, ΔVD>0, the image forming control section 7 reduces the amount of electrical charge supplied from the charging device 2. Consequently, the surface potential is decreased, and the value of ΔVD can therefore be closer to zero. Conversely, if VoD>0, ΔVD<0, the image forming control section 7 increases the amount of electrical charge supplied from the charging device 2. Consequently, the surface potential is increased, and the value of ΔVD can therefore be closer to zero. A target device for which driving conditions are changed is not limited to the above-described devices. For example, a method of changing driving conditions for both of the exposure device 3 and the charging device 2 so that the value of the dark potential deviation ΔVD becomes zero may be performed. Furthermore, the image forming control section 7 may control the bias voltage of the developing device 5 on the basis of the error corrected light potential measurement value VL or the error corrected dark potential measurement value VD. In the above-described control process, at least one of a charge process, an exposure process, and a development process is controlled using an error corrected potential measurement value. The error corrected potential measurement value can be obtained by performing computation using an error correction value and a potential measurement value. The error correction value is determined in a determination process in which an error correction value corresponding to the charge state of an electrostatic latent image is determined on the basis of the relationships between the charge states of the electrostatic latent image and error correction values which have been prepared in advance.

Thus, the above-described process is performed for each of a light latent image and a dark latent image. That is, print image forming is performed in accordance with an image signal while control processing is being performed so that the charge state of the surface of the image bearing member 1 is changed to a desired charge state.

As described previously, according to the first embodiment, it is possible to appropriately correct a measurement error included in a measurement result of the surface potential of a latent image formed on the surface of an image bearing member in accordance with the charge state of the latent image. The measurement error occurs under the influence of an electric field generated from a pre-exposed area. Consequently, both of the miniaturization of an image forming apparatus and the consistent high print quality can be achieved. That is, even in an image forming apparatus including a miniaturized image bearing member, it is possible to appropriately control image forming conditions using an accurate measurement result of the surface potential of a latent image. Thus, both of the miniaturization of the image bearing member and the consistent high print quality can be achieved.

In particular, the first embodiment brings the following advantages. Measurement of the light potential of a light latent image, which is formed by exposing a latent image forming area on the surface of an image bearing member to light, is most affected by an electric field generated from a pre-exposed area. Accordingly, at that time, the largest measurement error occurs. According to the first embodiment, it is possible to obtain an accurate light potential measurement value by appropriately correcting the above-described measurement error using an error correction value according to the charge state of the light latent image.

On the other hand, measurement of the dark potential of a dark latent image, which is formed from the latent image forming area on the surface of the image bearing member without being exposed to light, is largely unaffected by the electric field generated from the pre-exposed area. Accordingly, only a small degree of measurement error occurs. At that time, if the error correction value used for the above-described light potential measurement is used for this dark potential measurement, the value of the measurement error will be increased. According to the first embodiment, however, it is possible to obtain an accurate dark potential measurement value by appropriately correcting the above-described measurement error using an error correction value corresponding to the charge state of a dark latent image.

Figure 5:
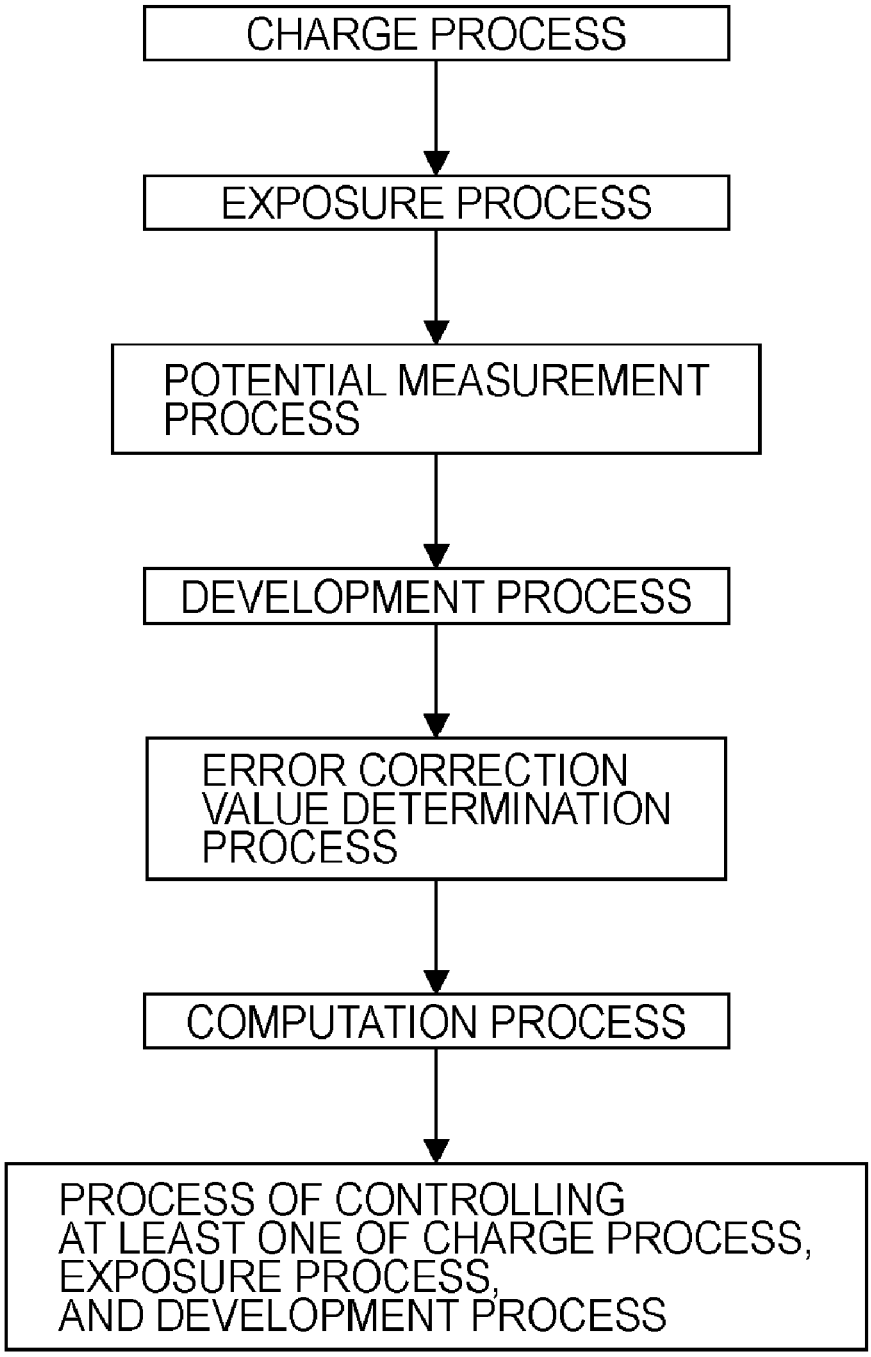
FIG. 5 is a flowchart illustrating an image forming method according to an embodiment of the present invention.
Figure 6:
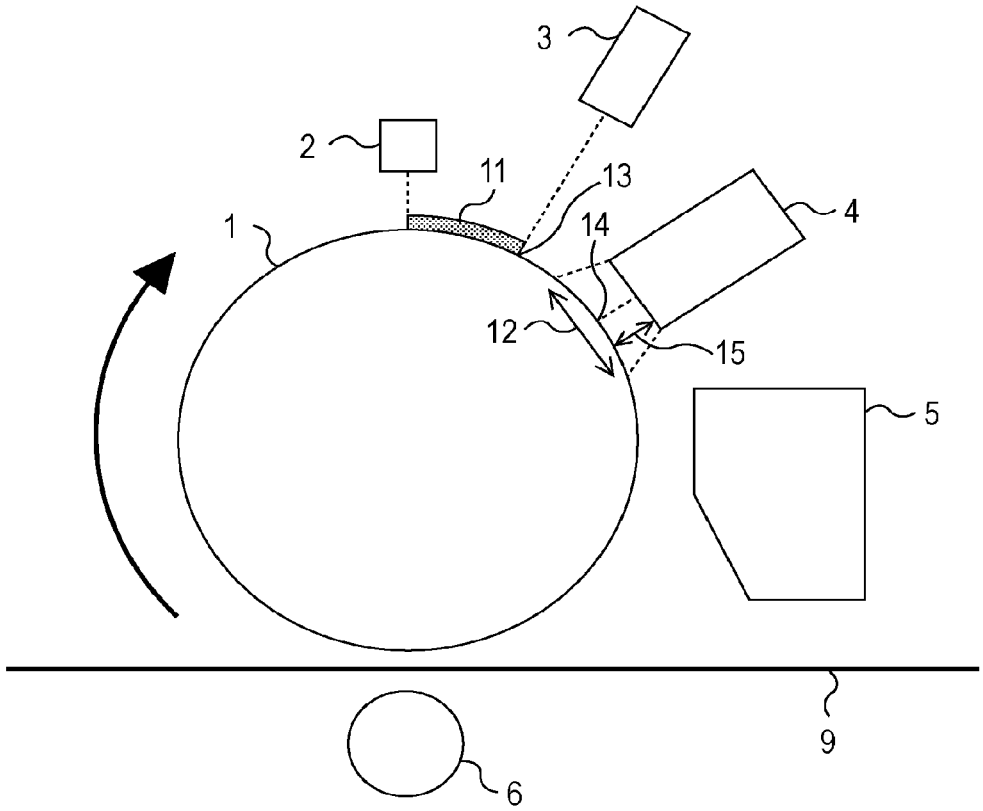
FIG. 6 is a diagram describing the problem of the present invention.

Next, an image forming method according to an embodiment of the present invention will be described with reference to a flowchart illustrated in FIG. 5. An image forming method according to an embodiment of the present invention includes the following processes: a charge process of charging the surface of an image bearing member; an exposure process of exposing the surface of the image bearing member to light; a potential measurement process of measuring the surface potential of an electrostatic latent image that is formed on the surface of the image bearing member through the charge process and the exposure process; a development process of developing the electrostatic latent image; a determination process of determining an error correction value corresponding to the charge state of the electrostatic latent image on the basis of the relationships between charge states of the electrostatic latent image and error correction values which have been obtained in advance; a computation process of computing an error corrected potential measurement value using the error correction value determined in the determination process and the potential measurement value measured in the potential measurement process; and a control process of controlling at least one of the charge process, the exposure process, and the development process on the basis of the error corrected potential measurement value computed in the computation process. The operations performed by the image forming apparatus in each of the processes have been described previously. The determination process of determining an error correction value, the computation process of computing an error corrected potential measurement value, and the control process of controlling at least one of the charge process, the exposure process, and the development process on the basis of the error corrected potential measurement value computed in the computation process may be performed at any time after the potential measurement process. For example, these processes may be performed before the development process.

Second Embodiment

An image forming apparatus and method according to the second embodiment will be described below. An image forming apparatus and method according to the second embodiment are preferably used in a case in which a target value of a pre-exposure potential is markedly changed. That is, an image forming apparatus and method according to the second embodiment are effective, for example, when at least one of the light potential control target value VoL and the dark potential control target value VoD is changed due to changes in the surrounding temperature and humidity environment of the image forming apparatus. The configuration of an image forming apparatus according to the second embodiment and the operations of the image forming apparatus at the time of print image forming are the same as those described in the first embodiment. Accordingly, the description thereof will be omitted.

Figure 3:
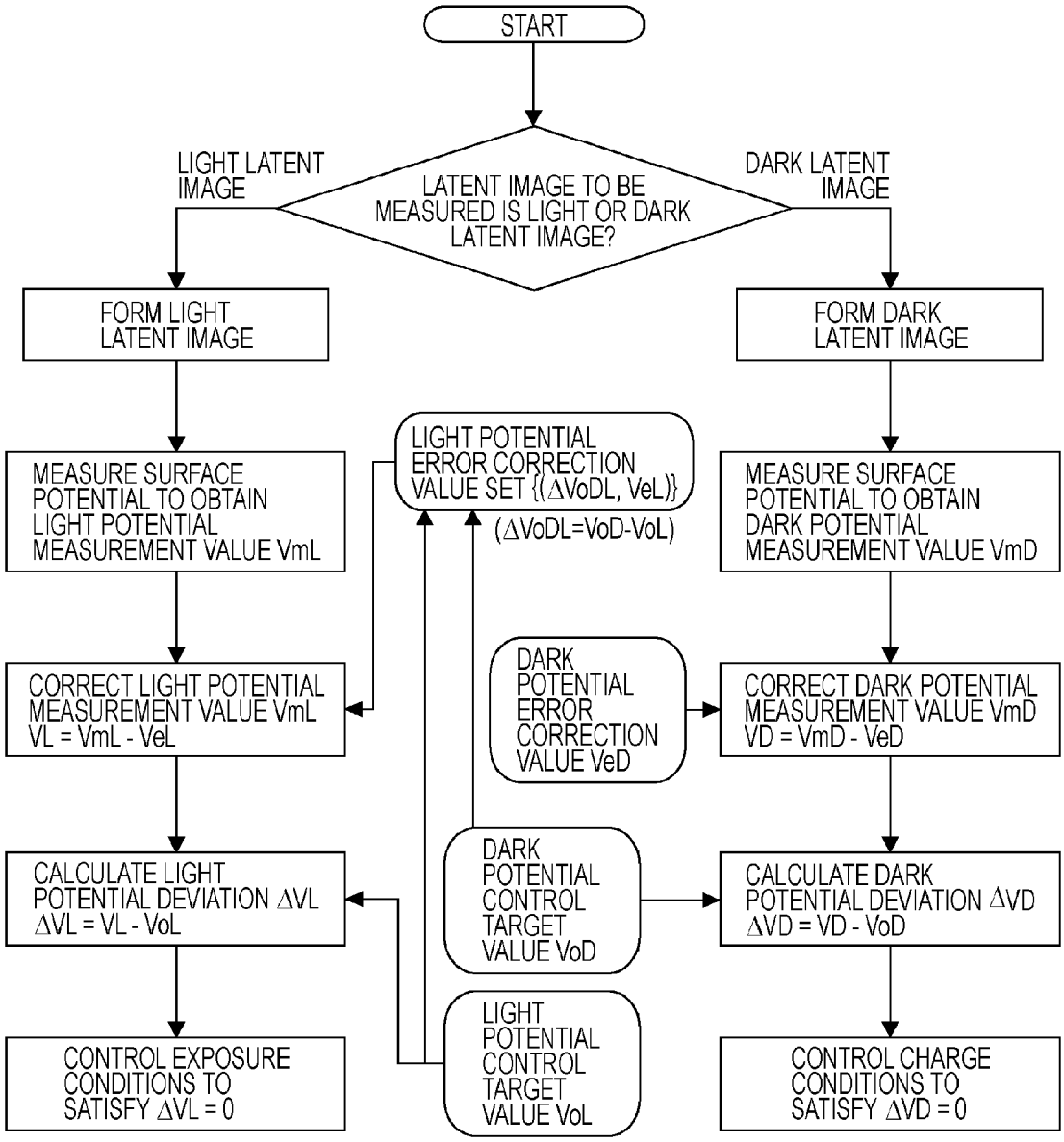
FIG. 3 is a flowchart illustrating a procedure for controlling image forming conditions in an image forming apparatus and method according to a second embodiment of the present invention.

A procedure for controlling image forming conditions in an image forming apparatus and method according to the second embodiment will be described with reference to a flowchart illustrated in FIG. 3. This control procedure is the same as that described in the first embodiment, except in the processing for correcting the light potential measurement value VmL.

A procedure for correcting the light potential measurement value VmL in an image forming apparatus and method according to the second embodiment will be described. The image forming control section 7 corrects a measurement error by subtracting the light potential error correction value VeL from the light potential measurement value VmL, thereby obtaining the error corrected light potential measurement value VL. Here, as the light potential error correction value VeL, an error correction value corresponding to a target value difference ΔVoDL that is the difference between the dark potential control target value VoD and the light potential control target value VoL is used.

At least two or more combinations of the target value difference ΔVoDL and the light potential error correction value VeL are obtained in advance using an experimental method or a numerical analysis method. A set of these combinations of both values is stored in the error correction value output section 8.

When selecting the light potential error correction value VeL to be used from the above-described set, a method of selecting one of the stored target value differences ΔVoDL which is closest to an actual target value difference ΔVoDL, and using the light potential error correction value VeL corresponding to the selected target value difference ΔVoDL is used.

According to the second embodiment, even if at least one of the light potential control target value VoL and the dark potential control target value VoD is changed due to changes in the surrounding temperature and humidity environment of the image forming apparatus, the light potential measurement value VL can be obtained using an error correction value corresponding to the target value difference ΔVoDL. Accordingly, it is also possible to appropriately control image forming conditions using an accurate measurement result of the surface potential of a latent image. Consequently, both of the miniaturization of an image bearing member and the consistent high print quality can be achieved.

Third Embodiment

An image forming apparatus and method according to the third embodiment will be described below. In the third embodiment, at least one of the following charge states can be measured: a charge state of a first latent image that has been charged by a charging device and then reached a measurement area of a potential measurement device without being exposed to light by an exposure device; a charge state of a second latent image that has been charged by the charging device, been exposed to light by the exposure device, and then reached the measurement area of the potential measurement device; and a charge state of a third latent image in which a charge density is lower than that in the charge state of the first latent image and is higher than that in the charge state of the second latent image. That is, an image forming apparatus and method according to the third embodiment are particularly effective for the case in which, for example, control processing is performed so as to maintain the gradation of a print density in a desirable state using an intermediate latent image. The configuration of an image forming apparatus according to the third embodiment and the operations of the image forming apparatus at the time of print image forming are the same as those described in the first embodiment. The description thereof will be therefore omitted. In this description, a latent image formed in such a manner that a latent image forming area on the surface of an image bearing member is exposed to light so that the charge density of the area becomes equal to or larger than that of the light latent image and becomes equal to or lower than that of the dark latent image is referred to as an "intermediate latent image". The surface potential of the intermediate latent image is referred to as an "intermediate potential". For example, the intermediate latent image can be formed by exposing the latent image forming area to light with a light quantity of exposure smaller than that required for creation of the light latent image. The light quantity of exposure can be controlled by, for example, changing a laser intensity or a laser pulse interval.

Figure 4:
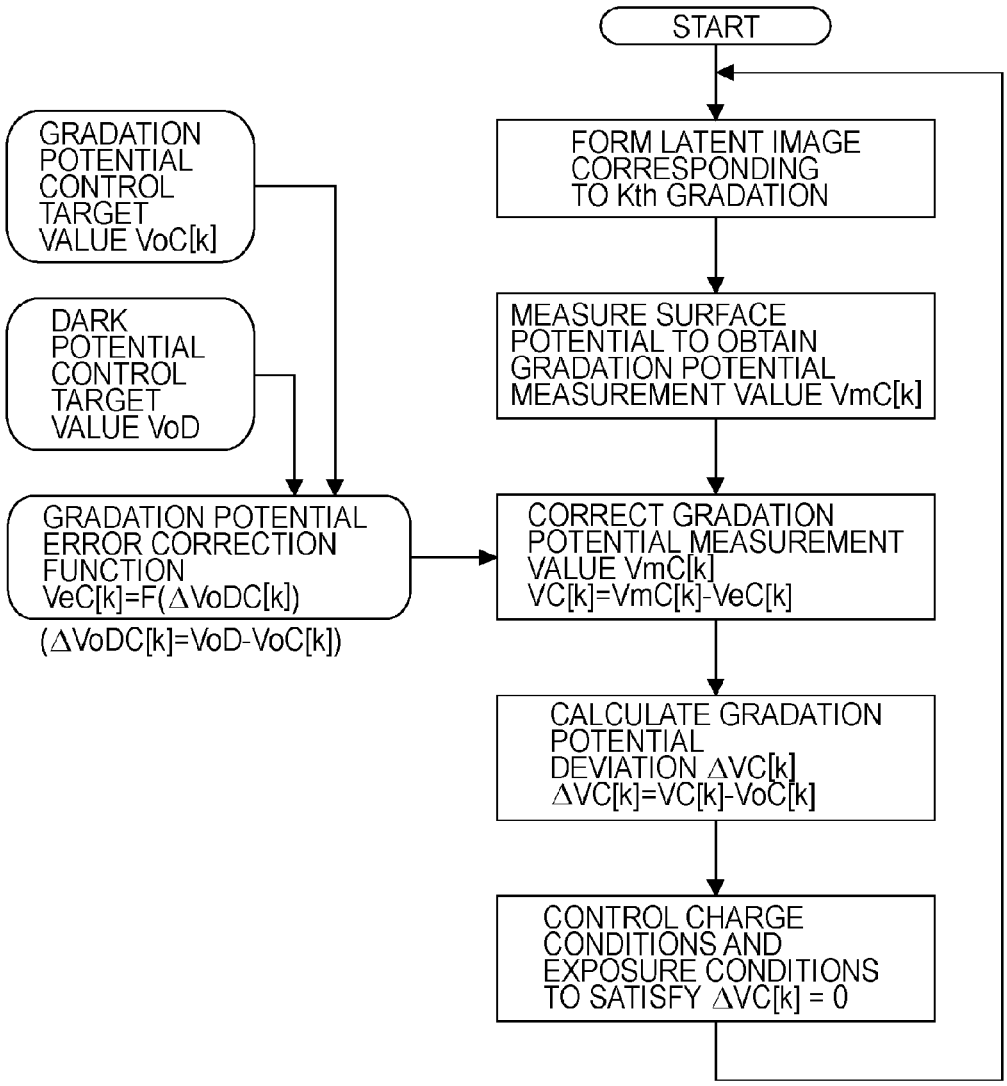
FIG. 4 is a flowchart illustrating a procedure for controlling image forming conditions in an image forming apparatus and method according to a third embodiment of the present invention.

A procedure for controlling image forming conditions in an image forming apparatus and method according to the third embodiment will be described with reference to a flowchart illustrated in FIG. 4.

First, the image forming control section 7 selects a charge state corresponding to a kth (k=1, 2, . . . , N) gradation level from among charge states corresponding to the number of N gradation levels (N is a natural number greater than two) as a charge state to be measured of the surface of the image bearing member 1. This selection is performed in accordance with a latent image charge state signal obtained from an image signal received by the image forming control section 7. The image forming control section 7 individually transmits control signals to the charging device 2 and the exposure device 3 on the basis of the selected charge state, thereby forming the selected latent image on the surface of the image bearing member 1. At that time, the image forming control section 7 controls the drive conditions for the charging device 2 and the exposure device 3 so that the value of the surface potential of the formed latent image becomes a surface potential control target value VoC[k] of the selected latent image corresponding to the kth gradation level (referred to as a "kth gradation level potential"). The symbol [k] denotes a value corresponding to the kth gradation level. The light potential control target value VoL is the same as VoC[1], and the dark potential control target value VoD is the same as VoC[N].

Subsequently, the potential measurement device 4 measures the surface potential of the above-described latent image, thereby obtaining a measurement value VmC[k]. Information about the measurement value is transmitted from the potential measurement device 4 to the image forming control section 7.

Subsequently, the image forming control section 7 subtracts an error correction value VeC[k] from the measurement value VmC[k], thereby correcting a measurement error and obtaining an error corrected potential measurement value VC[k]. Here, as the error correction value VeC[k], an error correction value corresponding to a target value difference ΔVoDC[k] between the dark potential control target value VoD and the control target value VoC[k] is used.

The relationship between the above-described target value difference ΔVoDC[k] and the error correction value VeC[k] is stored in the error correction value output section 8 in a functional form VeC[k]=F (ΔVoDC[k]). For example, the method of deriving the above-described function is as follows. First, the error correction values VeC[k] corresponding to the discrete target value differences ΔVoDC[k] are calculated in advance using an experimental method or a numerical analysis method. Subsequently, these discrete values are interpolated by polynomial interpolation such as linear interpolation, whereby an approximate continuous function can be obtained. In reality, an almost linear relationship is obtained when the target value differences ΔVoDC[k] and the error correction values VeC[k] are plotted. This error correction function denotes such a linear relationship. That is, this error correction function includes a variable that is roughly proportional to the charge density of a latent image (a function represented using the surface potential in the charge state of a latent image and a constant coefficient). This function is easy, and it is therefore appropriate for use in this embodiment.

Subsequently, the image forming control section 7 subtracts the control target value VoC[k] from the error corrected measurement value VC[k], thereby obtaining a deviation ΔVC[k] of the kth gradation level potential. This control target value is obtained in advance so as to achieve good gradation image forming conditions, and is then stored in the storage device. Subsequently, the image forming control section 7 controls drive conditions for the charging device 2 or the exposure device 3 so that the value of the above-described deviation ΔVC[k] becomes zero. Furthermore, the image forming control section 7 controls a bias voltage of the developing device 5 on the basis of the error corrected measurement value VC[k].

By performing the above-described process for each of charge states corresponding to a plurality of gradation levels, the gradation of a print density is controlled. Thus, print image forming is performed using a gradation control method in accordance with an image signal while control processing is being performed so that the gradation-based charge state of the surface of the image bearing member 1 is changed to a desired charge state.

As described previously, according to the third embodiment, it is possible to appropriately correct a measurement error included in a measurement result of the surface potential of a latent image formed on the surface of an image bearing member in accordance with the gradation-based charge state of the latent image. The measurement error occurs under the influence of an electric field generated from a pre-exposed area. In particular, in the case in which the intermediate potential of an intermediate latent image is measured, it is also possible to correct a measurement error using an error correction value corresponding to the charge state of the intermediate latent image. Accordingly, even in a miniaturized image forming apparatus, advanced image forming control such as gradation control of a print density can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-303678, filed 2006, Nov. 9, which is hereby incorporated by reference herein in its entirety.

What is claimed is:

1. An image forming apparatus comprising:

an image bearing member;

a charging device configured to charge a surface of the image bearing member;

an exposure device configured to expose the surface of the image bearing member to light;

a potential measurement device configured to measure a surface potential of an electrostatic latent image that is formed on the surface of the image bearing member by the charging device and the exposure device;

a developing device configured to develop the electrostatic latent image; and an image forming control unit configured to control image forming conditions, wherein the image forming control unit determines an error correction value corresponding to a charge state of the electrostatic latent image on the basis of relationships between charge states of the electrostatic latent image and error correction values which have been prepared in advance, computes an error corrected potential measurement value using the determined error correction value and a potential measurement value measured by the potential measurement device, and controls at least one of the charging device, the exposure device, and the developing device on the basis of the computed error corrected potential measurement value, and wherein the charge states of the electrostatic latent image include: (i) a charge state of a first latent image that has been charged by the charging device and then reached a measurement area of the potential measurement device without being exposed to light by the exposure device, (ii) a charge state of a second latent image that has been charged by the charging device, been exposed to light by the exposure device, and then reached the measurement area of the potential measurement device, and (iii) a charge state of a third latent image in which a charge density is lower than a charge density in the charge state of the first latent image and is higher than a charge density in the charge state of the second latent image.

2. The image forming apparatus according to claim 1, wherein the image forming control unit includes an error correction value output unit and a measurement error correction unit, wherein the error correction value output unit is configured to store the relationships between the charge states of the electrostatic latent image and the error correction values, and output the error correction value corresponding to the charge state of the electrostatic latent image to the measurement error correction unit in accordance with a latent image charge state signal, and wherein the measurement error correction unit is configured to compute the error corrected potential measurement value using the error correction value output from the error correction value output unit and the potential measurement value measured by the potential measurement device.

3. The image forming apparatus according to claim 2, wherein a set of at least two combinations of a charge state of the electrostatic latent image and an error correction value corresponding to the charge state are stored in the error correction value output unit as information denoting the relationships between charge states of the electrostatic latent image and error correction values.

4. The image forming apparatus according to claim 2, wherein an error correction value function including a variable that is proportional to a charge density in the charge state of the electrostatic latent image is stored in the error correction value output unit as information denoting the relationships between charge states of the electrostatic latent image and error correction values.

5. The image forming apparatus according to claim 1, wherein the image forming control unit controls driving conditions for at least one of the charging device, the exposure device, and the developing device so that a difference between the error corrected potential measurement value and a potential control target value becomes zero.

6. The image forming apparatus according to claim 1, wherein the error correction value for each respective charge state corresponds to a difference between a target value of a surface potential for the respective charge state and a target value of a surface potential for the charge state of the first latent image.

7. The image forming apparatus according to claim 1, wherein the error correction value for each respective charge state is calculated according to a function that is dependent on the surface potential of the respective charge state and a constant coefficient.

8. An image forming method comprising the steps of:

charging a surface of an image bearing member;

exposing the surface of the image bearing member to light;

measuring a surface potential of an electrostatic latent image that is formed on the surface of the image bearing member through the charging step and the exposing step;

developing the electrostatic latent image;

determining an error correction value corresponding to a charge state of the electrostatic latent image on the basis of relationships between charge states of the electrostatic latent image and error correction values which have been prepared in advance;

computing an error corrected potential measurement value using the error correction value determined in the determining step and a potential measurement value measured in the measuring step; and controlling at least one of a later iteration of the charging step, a later iteration of the exposing step, and the developing step on the basis of the error corrected potential measurement value computed in the computing step, wherein the charge states of the electrostatic latent image include a charge state of a first latent image that has been charged in the charging step and then reached a measurement area of the measuring step without being exposed to light in the exposing step, a charge state of a second latent image that has been charged in the charging step, been exposed to light in the exposing step, and then reached the measurement area in the measuring step, and a charge state of a third latent image in which a charge density is lower than that in the charge state of the first latent image and is higher than that in the charge state of the second latent image.

9. The image forming method according to claim 8, wherein the relationships between charge states of the electrostatic latent image and the error correction values are stored, the error correction value corresponding to the charge state of the electrostatic latent image in accordance with a latent image charge state signal is output, and the error corrected potential measurement value is computed using the potential measurement value and the error correction value output.

10. The image forming method according to claim 9, wherein a set of at least two combinations of a charge state of the electrostatic latent image and an error correction value corresponding to the charge state are stored as information denoting the relationships between charge states of the electrostatic latent image and error correction values.

11. The image forming method according to claim 9, wherein an error correction value function including a variable that is proportional to a charge density in the charge state of the electrostatic latent image is stored as information denoting the relationships between charge states of the electrostatic latent image and error correction values.

12. The image forming method according to claim 8, wherein driving conditions are controlled for at least one of the charging step, the exposing step, and the developing step so that a difference between the error corrected potential measurement value and a potential control target value becomes zero.

13. The image forming method according to claim 8, wherein the error correction value for each respective charge state corresponds to a difference between a target value of a surface potential for the respective charge state and a target value of a surface potential for the charge state of the first latent image.

* * * * *